US005203277A

United States Patent [19]

Norman

[11] Patent Number: 5,203,277

[45] Date of Patent: Apr. 20, 1993

[54] WINDSHIELD AND QUICK-RELEASE HINGE DEVICE

[75] Inventor: L. C. Norman, Maitland, Fla.

[73] Assignee: Water Bonnete Manufacturing, Inc., Casselberry, Fla.

[21] Appl. No.: 829,718

[22] Filed: Feb. 3, 1992

[51] Int. Cl.[5] ..... B67B 17/00

[52] U.S. Cl. ..... 114/361

[58] Field of Search ..... 114/343, 361; 403/165, 403/187, 263, 267, 315, 357, 397; 135/87, 88

[56] References Cited

U.S. PATENT DOCUMENTS

| | | | |
|---|---|---|---|
| 1,828,797 | 10/1931 | Becker . | |
| 2,499,136 | 2/1950 | Edlund et al. | 296/85 |
| 3,093,846 | 6/1963 | Reid | 114/361 |
| 3,304,657 | 2/1967 | Singleton | 114/361 |
| 3,810,267 | 5/1974 | Fussell et al. | 114/361 |
| 4,372,007 | 2/1983 | Lee | 16/260 |
| 4,532,870 | 8/1985 | Hayman | 109/58 |
| 4,729,134 | 3/1988 | Hillebrand et al. | 4/236 |
| 4,985,962 | 1/1991 | Weber | 16/232 |

*Primary Examiner*—JesûD. Sotelo
*Assistant Examiner*—Stephen P. Avila
*Attorney, Agent, or Firm*—James H. Beusse

[57] ABSTRACT

A windshield for use on a boat has a pair of stationary sections with a removable section mounted therebetween. The removable section has a set of open hinges for pivotal association with a hinge pin on one of the stationary sections. A plurality of cam sets on the removable section are releasibly engaged with the hinge pin to releasibly retain the open hinges against displacement from their pivotal associations with the hinge pin.

11 Claims, 2 Drawing Sheets

WINDSHIELD AND QUICK-RELEASE HINGE DEVICE

BACKGROUND OF THE INVENTION

In the past, a windshield for a boat was mounted to the hull of the boat generally between a forward deck adjacent the prow of the boat adjacent a compartment of the boat normally occupied by passengers. To provide access between the forward deck and the passenger compartment of the boat, some of the past windshields were provided with an openable section interposed between a pair of stationary sections of the windshield, and the openable section was pivotally secured to one of the stationary sections. When opened to provide access between the forward deck and the passenger compartment of the boat, the openable section of the windshield was swung about the stationary section to which it was pivotally secured into overlaying and abutting engagement with such stationary section. Of course, during the operation of the boat, vibrations were established, and such vibrations were transmitted to the aforementioned overlaid openable and stationary sections of the windshield causing relative vibratory movement thereof. It is believed that the vibratory movement so imparted to such overlaid openable and stationary sections of the windshield may have caused undesirable or deleterious marring or scratching of such overlaid openable and stationary sections of the windshield.

SUMMARY OF THE INVENTION

In one form of the invention, a windshield for a boat has a pair of spaced apart stationary windshield sections mounted to a part of the boat, and a stationary hinge pin is provided on one of the stationary windshield sections. Another windshield section is removably mounted between the stationary windshield sections, and another windshield section has a set of open hinge means for pivotal association with the stationary hinge pin. A plurality of sets of cam means is relatively movable on the another windshield section and associated with the open hinge means for releasable engagement with the stationary hinge pin to releasibly retain the open hinge means against displacement from their pivotal association with the stationary hinge pin, respectively.

A quick-release hinge device for use with a stationary hinge pin is provided in another form of the invention. The quick-release hinge device has a pivotally movable support, and at least one open hinge means is provided on the support for pivotal association with the stationary hinge pin. At least one set of cam means on the support is operable generally with relative movement for releasable engagement with the stationary hinge pin to releasibly retain the at least one open hinge means from its releasable association in pivotal engagement with the stationary hinge pin.

BRIEF DESCRIPTION OF THE DRAWINGS

Corresponding reference numerals indicate corresponding parts throughout the several views of the drawings.

The exemplifications set out herein illustrate preferred embodiments of the invention in one form thereof, and such exemplifications are not to be construed in any manner as limiting the scope of the invention.

DETAILED DESCRIPTION OF THE PREFERRED EMBODIMENTS

Figure 1:
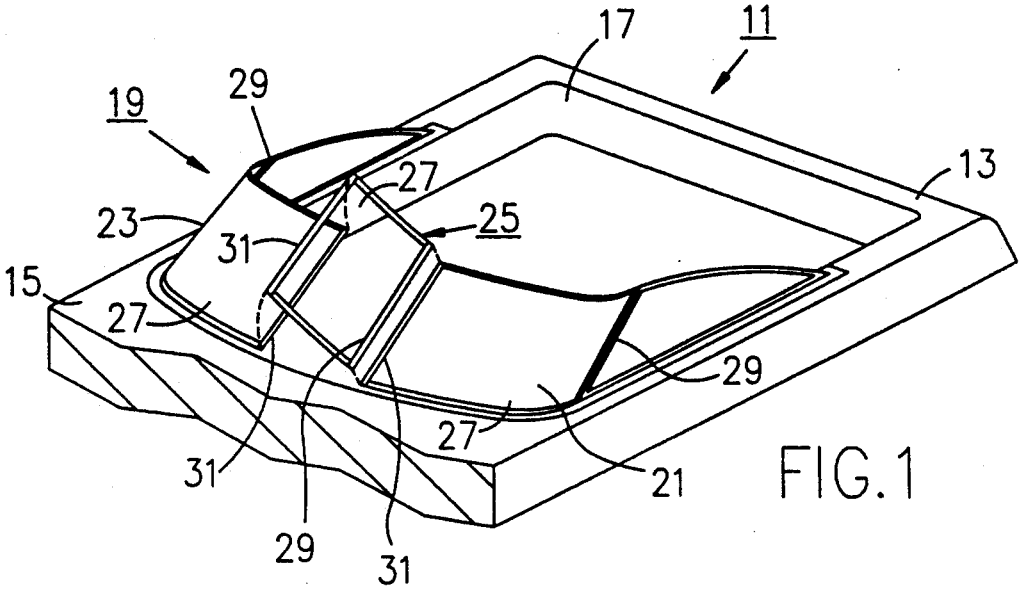
FIG. 1 is a partial perspective view illustrating in one form of the invention a windshield for a boat with the windshield having a removable section.

With reference now to the drawings in detail, there is shown in FIG. 1 a boat 11 having a hull 13 defining a forward deck 15 and a passenger compartment or well 17, and in one form of the invention, a windshield 29 is provided on the boat between the forward deck and the passenger compartment. Windshield 19 has a pair of spaced apart stationary sections 21, 23, and a removable section 25 of the windshield is releasibly associated with the stationary sections, as discussed in greater detail hereinafter, thereby to provide a passageway or convenient access between forward deck 15 and passenger compartment 17.

Figure 4:
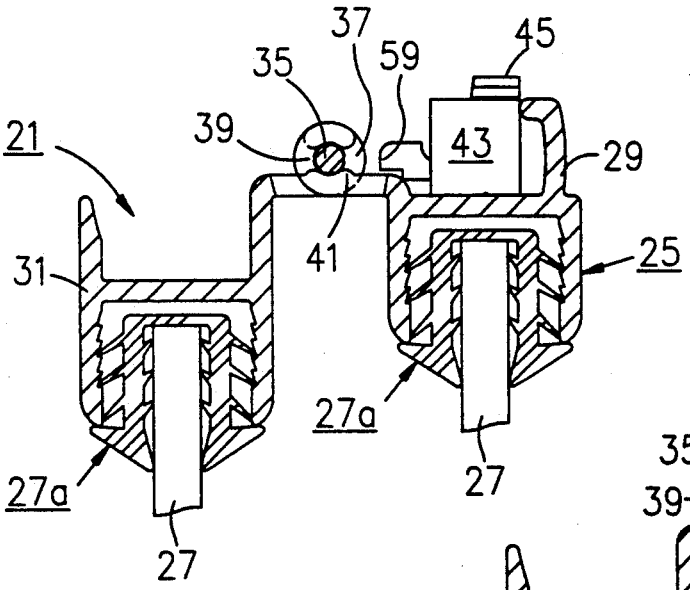
FIG. 4 is a sectional view taken along line 4—4 in FIG. 2 showing a hinge pin on the one stationary section pivotally received in an open hinge of the quick-release hinge device on the removable section.
Figure 5:
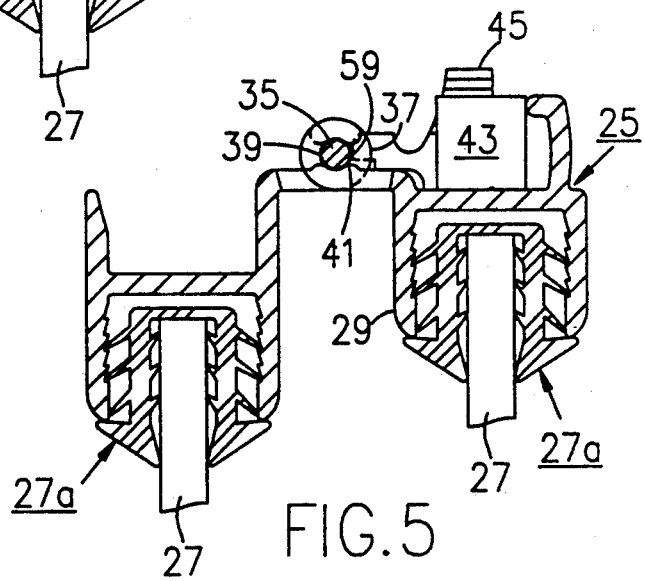
FIG. 5 is a sectional view generally the same as FIG. 4 but illustrating a set of cam means of the one quick-release hinge device associated in releasable engagement with the hinge pin.

Stationary sections 21, 23 and removable section 25 of windshield 19 respectively include a pane 27 of a transparent material, such as for instance a plastic or the like, supported in a resilient material or rubber grommet 27*a*, as best seen in FIGS. 4 and 5, between a pair of metallic channels or supports 29, 31, and channels 29, 31 of the stationary sections are respectively secured by suitable means (not shown) to forward deck 15 adjacent passenger compartment 17 thereby to arrange the stationary sections in spaced apart relation.

Figures 2, 3:
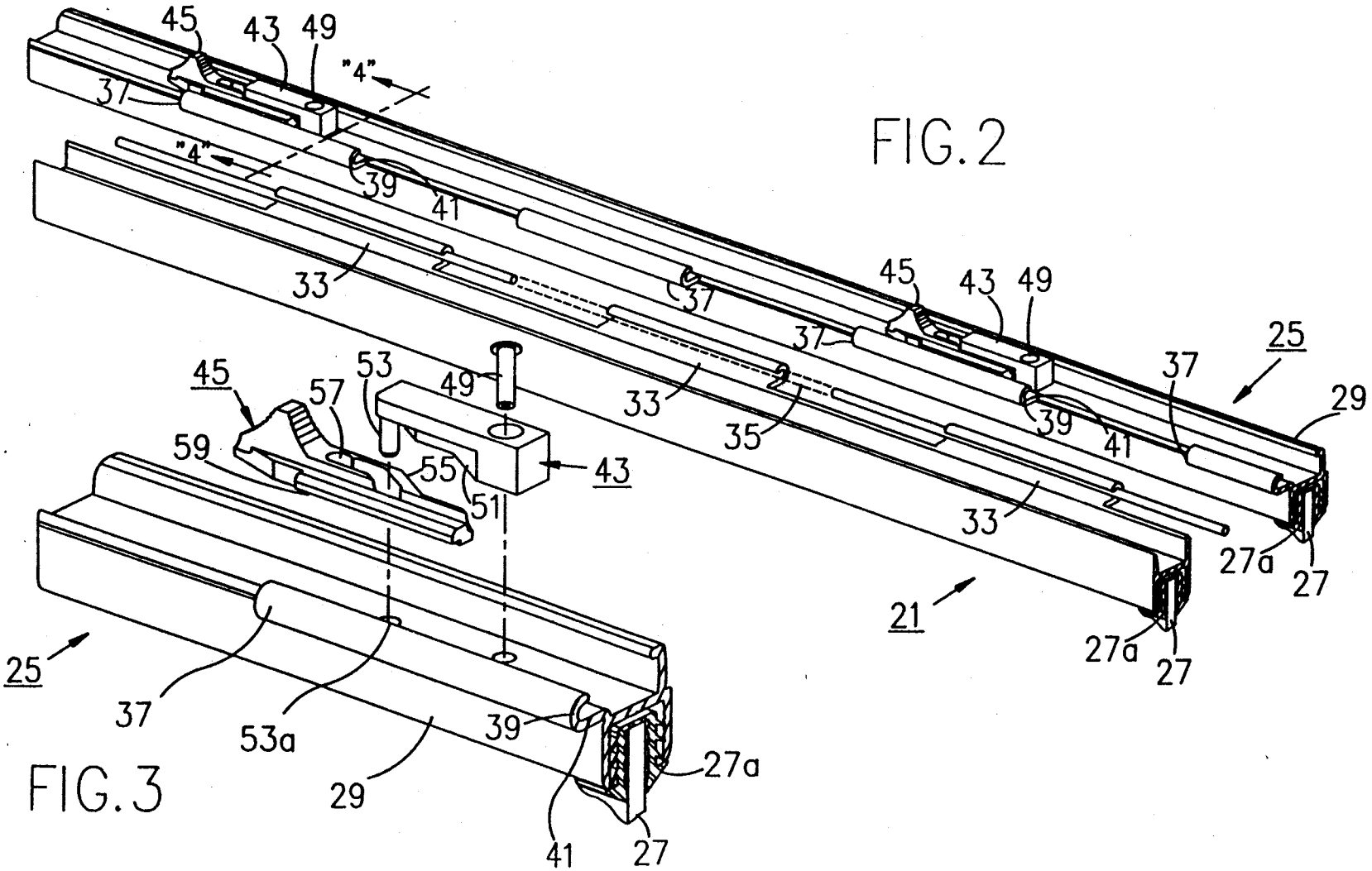
FIG. 2 is a partial perspective view of the removable section disposed in side-by-side relation with one of a pair of stationary sections of the windshield and illustrating in one form of the invention a set of quick-release hinge devices carried on the removable section.
FIG. 3 is an enlarged exploded perspective view showing one of the quick-release devices of FIG. 3 carried on the removable section.

As illustrated in greater detail in FIG. 2, channel 31 of stationary section 21 has a plurality of integral spaced apart flanges 33 extending generally laterally therefrom, and the flanges are arranged in gripping or mounting engagement with a stationary hinge pin 35 which extends between the flanges adjacent the channel.

Channel 29 of removable section 25 is provided with a plurality of integral spaced apart open hinges or open hinge means 37 extending generally laterally therefrom, and the spacing of the open hinges is effected for interfitting relation or pivotal abutting engagement of the open hinge between flanges 33 on channel 31 of stationary section 21. Each open hinge 37 has a seat 39 to pivotally receive or engage hinge pin 35, and a slot or slot means 41 extends through each open hinge 37 intersecting seat 39 to permit the passage of the hinge pin toward and away from its association in pivotal engagement with seat 39. Thus, upon the assembly of removable section 25 with stationary section 21 of windshield 19, as shown in FIGS. 4 and 5, open hinges 37 on channel 29 of removable section 25 are arranged generally in aligned relation between flanges 33 on channel 31 of stationary section 21, and slots 41 in the open hinges are passed over hinge pin 35 to arrange the hinge pin in pivotal engagement with seats 39 in the open hinges.

Subsequent to the aforementioned association of open hinge 37 in pivotal engagement with hinge pin 35, a plurality of sets of relatively movable cams 43, 45 provided on channel 29 of removable section 25 in predetermined laterally spaced relation with the open hinges are operable generally for releasable engagement with the hinge pin to releasibly retain the open hinges against displacement from their releasable association in pivotal engagement with the hinge pin, respectively, as seen in FIGS. 4 and 5. Since each set of cams 43, 45 are of like construction, only one set of the cams is described hereinafter for the sake of brevity of disclosure and drawing simplification.

As best seen in FIGS. 2 and 3, stationary cam 43 is secured against displacement on a cam supporting surface 47 on channel 29 of removable section 25 by suitable securing means, such as for instance a rivet 49 or the like. A stepped cam surface or face 51 is formed on cam 43, and an integral cam guide or post 53 on the cam depends therefrom in laterally spaced relation with cam face 51 into locating engagement with an opening 53*a* in cam supporting surface 47 on channel 29. Movable cam 45 is slidable on cam supporting surface 47 of channel 29 relative to cam 43, and another cam surface or face 55 on cam 45 is arranged in opposed engaging or sliding relation with the complementary cam face 51 on cam 43. Guide post 53 on cam 43 is slidably received within a guide slot 57 provided in cam 45 thereby to retain the cams against separation from each other on supporting surface 47 of channel 29, and the guide slot has a preselected configuration to accommodate the camming or displacement movement of cam 45 with respect to cam 43 in response to the camming engagement between cam faces 51, 55. An elongate abutment or abutment means 59 is integrally provided on cam 45 extending generally in facing relation with slot 41 of open hinge 37 and arranged in predetermined spaced apart relation with the open hinge when cams 43, 45 are in their at-rest positions, as seen in FIGS. 3 and 4. Of course, the predetermined spaced apart relation between open hinge 37 and elongate abutment 59 is provided to accommodate the passage of hinge pin through slot 41 of the open hinge into pivotal engagement with seat 39 of the open hinge, as previously discussed.

When hinge pin 35 is disposed in pivotal engagement with seats 39 in both of open hinges 37, removable section 25 of windshield 19 is pivotally associated with stationary section 21 thereof, and in order to maintain such pivotal association, cams 45 may be manually slidably moved from their at-rest positions on supporting surface 47 of channel 29, as seen in FIGS. 2–4, relative to cams 43 toward their camming positions, illustrated in FIG. 5, effecting the camming engagements of cam faces 51, 55, respectively. In response to the respective camming engagements of cam faces 51, 55, cams 45 are cammed or displaced generally laterally with respect to cams 43, and elongate abutments 59 on cams 45 are moved at least adjacent slots 41 or in part into slots 41 in open hinges 37 into releasable displacement preventing engagement with hinge pin 35 to releasibly retain the hinge pin against displacement from its association in pivotal engagement with seats 39 of the open hinges, respectively, as best seen in FIG. 5.

In order to disassociate removable section 25 from stationary section 21 of windshield 19, cams 45 may be manually moved from their camming positions, as seen in FIG. 5, into their at-rest positions to interrupt the camming engagements of cam faces 51, 55 and displace or release elongate abutments 59 on cams 45 from their engagements with hinge pin 35, respectively, as seen in FIG. 4. Upon the disengagements of elongate abutments 59 from hinge pin 35, open hinges 37 may be moved relative to hinge pin 35 to pass the hinge pin through slots 41 and the aforementioned predetermined space between the open hinges and the elongate abutments on cams 45 in their at-rest positions, respectively. When open hinges 37 are so disassociated from hinge pin 35, as discussed above, removable section 25 is disassociated from stationary section 21 of windshield 19 and may be removed therefrom to provide the aforementioned passageway through stationary sections 21, 23 of the windshield between forward deck 15 and passenger compartment 17 of boat 11, as illustrated in FIG. 1.

To complete the foregoing description, a quick-release hinge device comprises a respective set of cams 43, 45 and an open hinge 37 associated therewith on channel 29 of removable section 25. Furthermore, it is contemplated that a suitable releasable latch or mechanism (not shown) may be carried by channel 31 on removable section 25 and by channel 31 on stationary section 23 of windshield 19 to releasibly retain the removable section in a closed position between stationary sections 21, 23 when the removable section is pivotally associated with stationary section 21.

In view of the foregoing, it is now apparent that a novel windshield for use on a boat and a novel quick-release hinge device are respectively presented, and it is contemplated that changes may be made by those having ordinary skill in the art with respect to the arrangements, details, and connections of the component parts of such windshield and quick-release hinge device without departing from the spirit of the invention or the scope thereof as defined by the claims which follow.

What is claimed is:

1. A windshield for use on a boat comprising:

a pair of spaced part stationary windshield sections mounted to a part of the boat, one of said stationary windshield sections including a stationary hinge pin;

another windshield section removably mounted between said stationary windshield sections, said another windshield section including a set of open hinge means for pivotal association with said stationary hinge pin; and a plurality of sets of cam means relatively movable on said another windshield section and associated with said open hinge means for releasable engagement with said stationary hinge pin to releasibly retain said open hinge means against displacement from their pivotal associations with said stationary hinge pins, respectively.

2. The windshield as set forth in claim 1 wherein each open hinge means includes slot means arranged generally in facing relation with a respective one of said cam means sets for the passage of said stationary hinge pin into the pivotal association with said open hinge means, one of said cam means of each cam means set being movable relative to another of said cam means of each cam means set into the releasable engagement with said stationary hinge pin to releasibly retain said open hinge means against displacement from their pivotal association with said stationary hinge pin, respectively.

3. The windshield as set forth in claim 2 wherein said one cam means of each cam means set includes abutment means disposed at least adjacent said slot means and in releasable engagement with said stationary hinge pin for releasibly retaining said open hinge means against displacement from their pivotal association with said stationary hinge pin.

4. The windshield as set forth in claim 1 wherein said cam means of each cam means set respectively includes a pair of opposed cam surfaces arranged in camming engagement with each other in response to the relative movement of respective ones of said cam means of each cam means set to effect the releasable engagements of said respective ones of said cam means with said stationary hinge frame.

5. The windshield as set forth in claim 1 wherein each open hinge means includes a seating surface arranged to receive said stationary hinge pin in pivotal engagement, a slot intersecting said seating surface and arranged generally in facing relation with said cam means of a respective one of said cam means sets to accommodate the passage of said stationary hinge pin into pivotal engagement with said seating surface and the displacement of said hinge means from said stationary hinge pin, said cam means of said cam means sets each including a pair of opposed cam surfaces arranged in camming engagement with each other upon the movement of one of said cam means of said cam means set into a preselected camming position relative to another of said cam means of said cam means sets, and an abutment surface on said one cam means of each cam means set arranged at least adjacent said slot and disposed in releasable engagement with said stationary hinge pin to releasibly retain said seating surfaces in their pivotal engagements with said stationary hinge pin when said one cam means of said cam means sets are in their preselected camming positions, respectively.

6. A quick-release hinge device for use with a stationary hinge pin comprising:

a support;

at least one open hinge means on said support for releasable association in pivotal engagement with the stationary hinge pin; and at least one set of cam means on said support and operable generally with relative movement for releasable engagement with the stationary hinge pin to releasibly retain said at least one open hinge means against displacement from its releasable association in pivotal engagement with the stationary hinge pin.

7. The quick-release hinge device as set forth in claim 6 wherein said at least one open hinge means includes means for the passage of the stationary hinge pin into the releasable association in pivotal engagement with said at least one open hinge means, one of said cam means being movable relative to another of said cam means into the releasable engagement with the stationary hinge pin to releasibly retain the stationary hinge pin against displacement through said passage means from the pivotal engagement with said at least one open hinge means.

8. The quick-release hinge device as set forth in claim 7 wherein said one cam means includes abutment means disposed at least adjacent said passage means for the releasable engagement with the stationary hinge pin upon the relative movement of said one cam means.

9. The quick-release hinge device as set forth in claim 6 wherein said cam means includes a set of opposed cam surfaces, said cam surface being disposed in camming engagement upon the operation of said cam means to effect the relative movement of one of said cam means into the releasable engagement with the stationary hinge pin.

10. The quick-release hinge device as set forth in claim 6 wherein one of said cam means includes a cam groove and another of said cam means includes a cam guide slidable in said cam groove to accommodate the relative movement of said cam means.

11. The quick-release hinge device as set forth in claim 6 wherein said at least one open hinge means includes a seating surface releasibly associated in the pivotal engagement with the stationary hinge pin, a slot intersecting said seating surface to accommodate the passage of the stationary hinge pin into pivotal engagement with said seating surface, said cam means including a set of opposed cam surfaces arranged in camming engagement with each other in response to the movement of one of said cam means relative to another of said cam means, and an abutment on said one cam means arranged at least adjacent said slot and disposed in releasable engagement with the stationary hinge pin to releasibly retain the pivotal engagement of said seating surface with the stationary hinge pin upon the movement of said one cam means relative to said another cam means.

* * * * *